United States Patent [19]

Ogawa

[11] Patent Number: 4,527,968

[45] Date of Patent: Jul. 9, 1985

[54] VANE-TYPE PUMP WITH ROTATABLE CASING THEREIN DRIVEN FROM PUMP SHAFT

[75] Inventor: Hitoshi Ogawa, Himeji, Japan

[73] Assignee: Mitsubishi Denki Kabushiki Kaisha, Tokyo, Japan

[21] Appl. No.: 580,635

[22] Filed: Feb. 16, 1984

[30] Foreign Application Priority Data

Mar. 4, 1983 [JP] Japan ..... 58-31753[U]

[51] Int. Cl.[3] ..... F04C 2/348

[52] U.S. Cl. ..... 418/173; 418/164

[58] Field of Search ..... 418/164, 172, 173, 174

[56] References Cited

U.S. PATENT DOCUMENTS 1,610,748 12/1926 Cozette ..... 418/173

2,241,824 5/1941 Meyerhoefer ..... 418/173 X

*Primary Examiner*—Leonard E. Smith

*Attorney, Agent, or Firm*—Wenderoth, Lind & Ponack

[57] ABSTRACT

A vane-type pump having a rotatable shaft, a cylindrical housing, a rotor secured to the shaft so as to be rotated within the housing with the center line being offset from that of the housing, and a number of vanes radially shiftably received within the radial slots formed in the rotor is disclosed wherein a cylindrical casing is disposed between the cylindrical inner periphery of the housing and the rotor, the cylindrical inner periphery of the casing being adapted to have the radially outward peripheries of the vanes abut against it due to centrifugal force applied thereto when they are rotated together with the rotor, and the casing is constituted to be rotated by the shaft through any suitable transmission mechanism arranged between them in the same direction as the rotational direction of the rotor, but at a velocity lower than that of the shaft.

4 Claims, 5 Drawing Figures

VANE-TYPE PUMP WITH ROTATABLE CASING THEREIN DRIVEN FROM PUMP SHAFT

BACKGROUND OF THE INVENTION

The present invention relates to a pump and more particularly to an improvement in a vane-type pump.

A hitherto known pump of this type, namely a vacuum pump to be mounted to a vehicle generator, is shown in FIGS. 1 and 2 of the accompanying drawings. In these drawings reference numeral 1 designates a frame of the vehicle generator, 2 designates a shaft rotatively supported in the bore 1*a* formed in the frame 1 by means of a bearing 3 fit therein, 2*a* designates splines formed on the shaft 2 on the free end portion thereof, and 4 designates a rotor splined to the shaft 2 by the splines 2*a*. The rotor 4 is provided with a number of radial slots 4*a* at regular angular intervals (in the embodiment shown the number of radial slots 4*a* is 3), and a rectangular plate-like vane 5 is radially shiftably received in each of the slots 4*a*. A cylindrical housing 6, open at one end and closed at the other end, has a generally cylindrical inner peripheral surface 6*a* the center line of which is eccentric with respect to the center line 6 of the shaft 2, i.e. the center line of the rotor 4, the housing 6 being secured to the frame 1 at the open end by a number of fastening bolts 7. A packing 8 is held by the housing 6 within an annular groove formed therein to hermetically seal it to the frame 1, and an oil seal 9 is secured in the bore 1*a* of the housing 1 so as to abut against the outer surface of the shaft 2 for hermetically sealing an operating chamber 10 of the pump formed within the housing 6 from the outside. A suction port 11 is formed in the housing 6 through its peripheral wall, and a discharge port 12 is similarly formed therein so as to be generally diametrically opposite to the suction port 11, and a lubricant oil feed orifice 13 opens through the end wall of the housing 6 in alignment with the center line $2_1$ of the shaft 2, the suction port 11, discharge port 12, and lubricant oil feed orifice 13 being connected to a not-illustrated vacuum tank, oil pan, and lubrication pump, respectively.

The operation of the conventional vacuum pump having such a construction as described above is as follows.

Upon rotation of the shaft 2 in the direction indicated by the arrow, the vanes 5 are urged radially outwards due to centrifugal force applied thereto so that they rotate together with the rotor 4 with the radially outward ends of the vanes 5 abutting against the cylindrical inner peripheral surface 6*a* of the housing 6. Air is thereby sucked through the suction port 11 and discharged through the discharge port 12, and a pumping action is thus performed. The lubricant oil supplied from the lubricant oil feed orifice 13 to the housing 6 lubricates the surfaces of the radially outward ends of the vanes 5 and the cylindrical inner periphery 6*a* of the housing 6 and is then entrained with the discharged air to be discharged from the discharge port 12 into the oil pan.

Since the conventional vane-type pump has the construction and operation described above, when the pump is operated at a high velocity or without lubrication, the radially outward ends of the vanes 5 are extraordinally worn due to friction occurring between them and the cylindrical inner periphery 6*a* of the housing 6, and in the case where the vane 5 is made of carbon, the bonds between the carbon particles at the shifting portion contacting the cylindrical inner periphery of the housing 6 are weakened to cause breaking off of portions of the vane 5, and the durability of the vane 5 considerably deteriorates. For this reason, high-speed operation and operation without lubrication of a pump of this type are difficult.

A vane-type pump of this kind is disclosed in Japanese Laid-Open Utility Model Publication No. 29406/1979, but this conventional pump does not disclose the use of a cylindrical casing disposed between the cylindrical inner periphery of the housing and the rotor, the casing being rotated by the shaft directly or indirectly so that the relative velocity between the cylindrical inner periphery of the casing and the radially outward ends of the vanes which are urged to abut against them is greatly reduced as in the present invention to be described fully hereinbelow.

SUMMARY OF THE INVENTION

It is an object of the present invention to provide a vane-type pump comprising a housing, a rotor eccentrically received therein so as to be rotated relative thereto, and a number of vanes radially shiftably received within radial slots formed in the rotor which can eliminate all of the defects inherent in a conventional pump of this type as described above.

It is another object of the present invention to provide a vane-type pump which can greatly reduce the relative velocity between the radially outward ends of the vanes and the cylindrical inner periphery of the housing.

It is a further object of the present invention to provide a vane-type pump which can easily make the rotational speed of the rotor higher or allow the rotor to be rotated without lubrication.

It is a still further object of the present invention to provide a vane-type pump in which the housing can easily follow the vanes even when the rotor is rapidly accelerated or decelerated.

It is a further object of the present invention to provide a vane-type pump which can increase substantially the pump capacity compared with a conventional pump of this type having substantially identical dimensions or outline.

In accordance with the present invention a vane-type pump is provided in which there is disposed between the cylindrical inner periphery of the housing and the rotor a cylindrical casing the cylindrical inner periphery of which is adapted to have the radially outward ends of the vanes abut against it due to centrifugal force generated when they are rotated together with the rotor, the casing being driven by the shaft through any suitable transmission mechanism arranged between them in the same direction as the rotational direction of the shaft, but at a velocity lower than that of the shaft.

BRIEF DESCRIPTION OF THE DRAWINGS

These and other objects of the present invention will become more readily apparent upon reading the following descriptions and upon reference to the accompanying drawings in which:

In FIGS. 3 to 5 the elements similar or corresponding to those shown in FIGS. 1 and 2 bear the same reference numerals as used in FIGS. 1 and 2.

DESCRIPTION OF THE PREFERRED EMBODIMENTS

Figure 2:
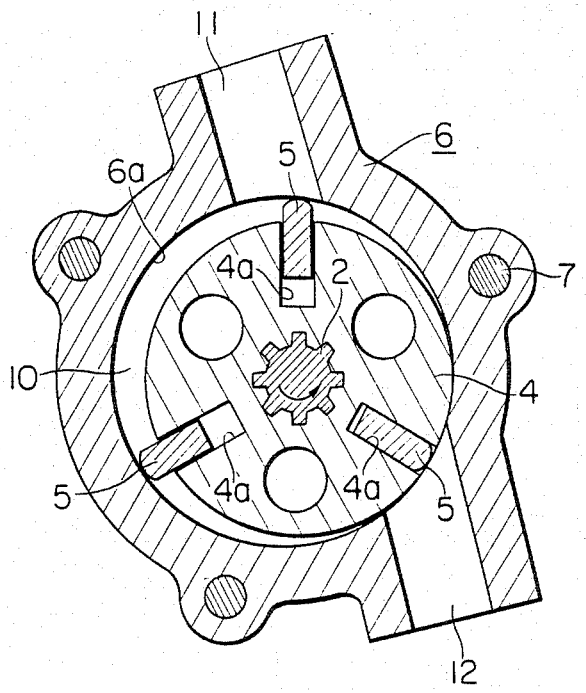
FIG. 2 PRIOR ART
FIG. 2 is a transversal sectional view of the pump shown in FIG. 1 taken along the lines II—II of FIG. 1.
Figure 1:
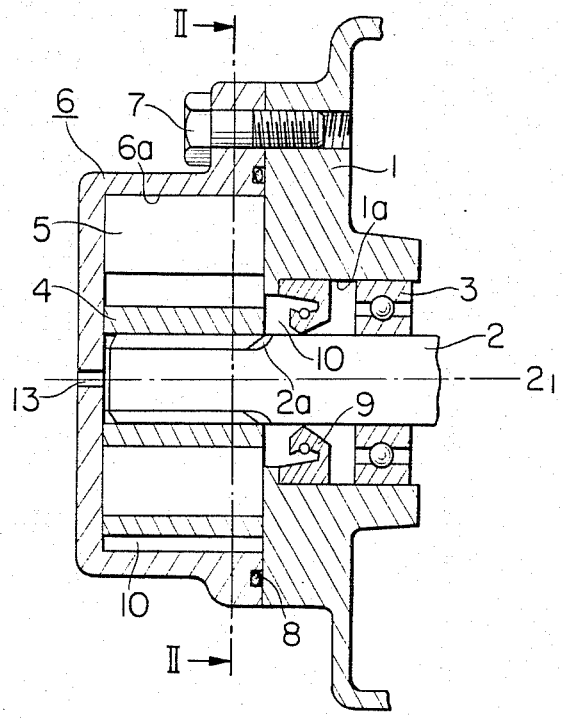
FIG. 1 PRIOR ART
FIG. 1 is a longitudinal sectional view of a conventional vane-type pump.
Figure 4:
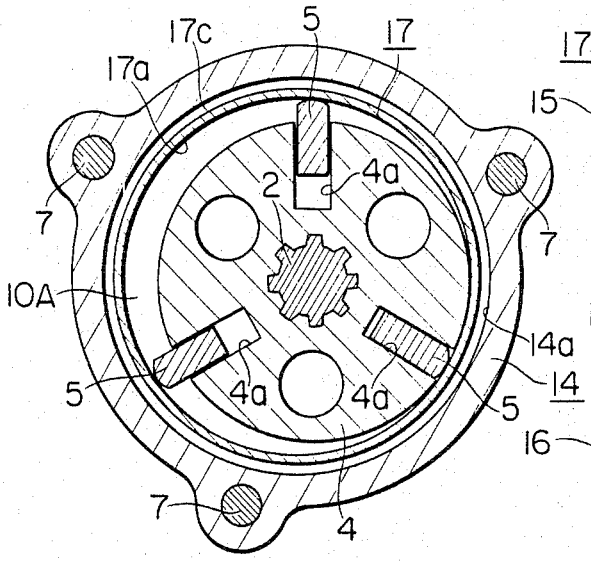
FIG. 4 is a transverse sectional view of the pump shown in FIG. 3 taken along the lines IV—IV of FIG. 3.
Figure 3:
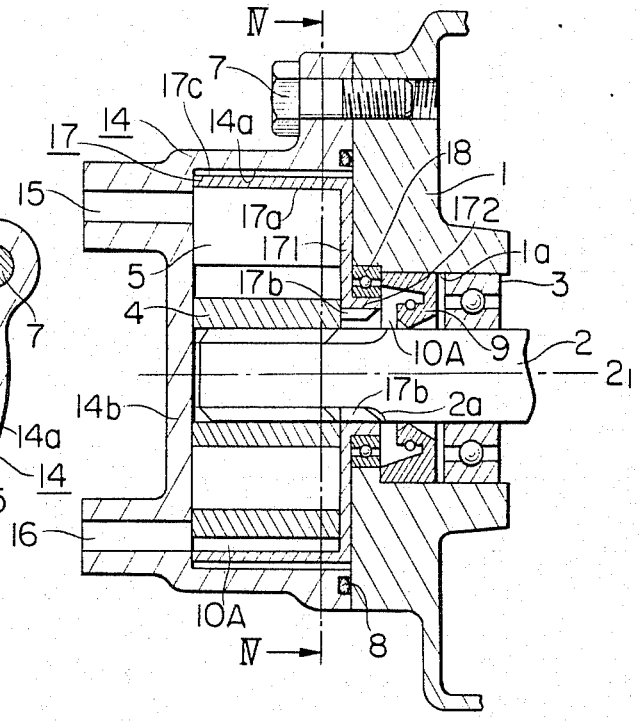
FIG. 3 is a longitudinal sectional view of one embodiment of the vane-type pump in accordance with the present invention.

Reference is made now to FIGS. 3 and 4 wherein is shown an embodiment of the present invention. In these drawings reference numeral 14 designates a cylindrical housing secured to the frame 1 by means of a number of fastening bolts 7 in a manner similar to that used to secure the housing 6 shown in FIG. 1, and it has a cylindrical inner periphery 14*a*, the center of which is eccentric with respect to the center line $2_1$ of the shaft 2, i.e. the center line of rotor 4. A suction port 15 and a discharge port 16, respectively, are provided in the end wall 14*b* of the housing 14. A cylindrical casing 17 has an open end confronting the end wall 14*b* of the housing, a closed end which confronts the frame and is closed by an end wall 171, and a cylindrical boss 172 concentrically formed thereon so as to protrude outwards and is rotatably supported within the bore 1*a* of the frame 1 centrally thereof by means of a bearing 18 so as to be rotated together with the shaft 2. For this reason, there is left a small annular gap between the inner and outer cylindrical peripheries 14*a*, 17*c* of the housing 14 and the casing 17, respectively. Thus the cylindrical casing 17 is disposed between the cylindrical inner periphery 14*a* of the housing 14 and the rotor 4. The casing 17 is provided with a cylindrical inner periphery 17*a* against which the radially outward ends of the vanes 5 are adapted to abut, and it forms an operating pump chamber 10A in association with the end wall 14*b* of the housing 14 and the rotor 4. An internal gear 17*b* is formed within the inner periphery of the cylindrical boss 172 of the casing 17, the teeth of the gear 17*b* corresponding to the splines 2*a* of the shaft 2. Thus, the gear 17*b* is in mesh with the corresponding splines 2*a* formed on the shaft 2 so as to transmit the rotation of the shaft 2 to the casing 17 at a reduced velocity compared with that of the shaft 2.

Now the operation of the embodiment described above and illustrated in FIGS. 3 and 4 will be explained with reference to FIGS. 3 and 4.

Upon rotation of the shaft 2, the vanes 5 are thrust radially outwards due to centrifugal force applied thereto so that they rotate together with the rotor 4 with the radially outward ends of the vanes 5 abutting against the cylindrical inner periphery 17*a* of the casing 17. At the same time, the casing 17 is driven by the shaft 2 so as to be rotated in the same direction as the rotational direction of the vanes 5, but at a velocity considerably lower than the revolutional velocity of the vanes 5. Therefore, the relative velocity between the radially outward periphery of the vane 5 and the cylindrical inner periphery 17*a* of the casing 17 is greatly reduced compared with a conventional vane-type pump wherein the vanes 5 are adapted to be outwardly against the stationary cylindrical inner periphery 6*a* of the housing 6. Furthermore, in the embodiment illustrated, even when the rotor 4 is abruptly accelerated or decelerated a uniform low relative velocity between the radially outward ends of the vanes 5 and the cylindrical inner periphery 17*a* of the casing 17 is maintained.

Figure 5:
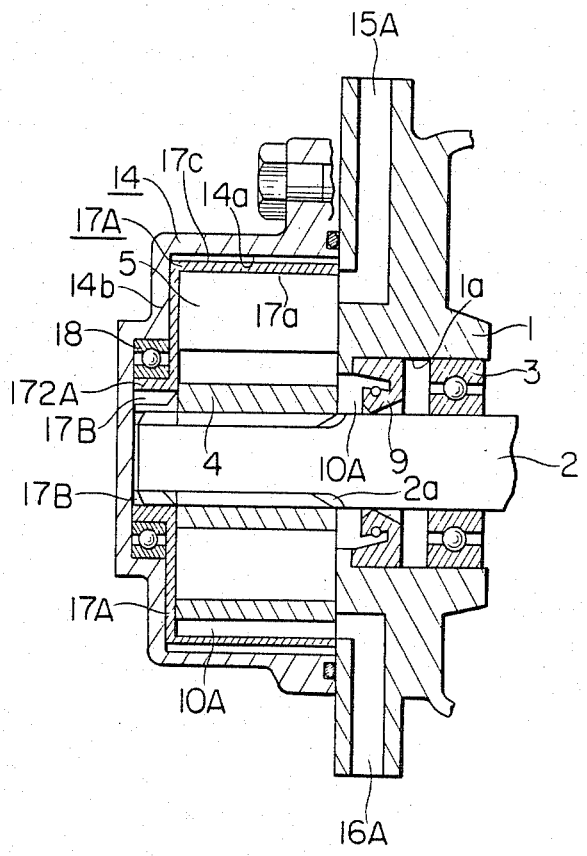
FIG. 5 is a longitudinal sectional view of another embodiment of the vane-type pump in accordance with the present invention.

Another embodiment of the present invention is shown in FIG. 5. Since this embodiment does not substantially differ in operation from the embodiment shown in FIGS. 3 and 4, only the structure differences between them will be briefly explained herein. In the embodiment shown in FIG. 5 the suction port 15A and discharge port 16A are provided in the frame 1 substantially diametrically opposite one another, the end of the casing 17A which confronts the frame 1 is open and the other end which confronts the end wall 14*b* of the housing 14 is closed by an end wall 171A. The casing 17A also has a cylindrical boss 172A protruding outwards from the end wall 171A centrally thereof which is rotatively supported in the housing 14 centrally thereof by means of a bearing 18 housed within the housing 14. The casing 17A is adapted to be driven by the shaft 2 with the splines 2*a* formed thereon being engaged with the internal gear 17B correspondingly formed in the inner periphery of the cylindrical boss 172A so that the casing 17A is rotated in the same direction as the rotational direction of the rotor 4, but at a different velocity.

Although in both embodiments, the rotation of the shaft 2 is transmitted directly to the housing 17 or 17A through a spline coupling, the transmission of rotation may be accomplished through any suitable means such as gears, belts, or the like, and the transmission ratio between the shaft and the casing may be selected as desired.

Furthermore, although the pump according to the present invention has been described as a vacuum pump to be used in association with automobile dynamos, the pump in accordance with the present invention can be just as well used as a compressor, an air pump, etc. to be operated through pulleys from an electric motor or other driving sources. Also it can be utilized as a pump for a liquid.

It is also to be understood that although certain forms of the present invention have been illustrated and described, it is not to be limited thereto except insofar as such limitations are included in the following claims:

What is claimed is:

1. A vane-type pump comprising:

a frame;

a splined shaft rotatably supported on said frame;

a rotor splined to said shaft concentric with the axis of said shaft and having a plurality of radial slots therein;

a plurality of vanes radially shiftably mounted in said radial slots;

a housing secured to said frame around said shaft and rotor and having a cylindrical inner periphery the center of which is eccentric with respect to the axis of said shaft and an end wall closing said housing at the end remote from said frame, said frame closing the other end of said housing; and a cylindrical casing rotatably mounted between said cylindrical inner periphery of said housing and the outer periphery of said rotor and having a cylindrical inner periphery against which the radially outer ends of said vanes abut to define an operating chamber;

said pump having a suction port opening into said housing and a discharge port opening out of said housing in communication with said operating chamber;

said casing having an internal gear thereon larger in diameter than said splined shaft and in toothed engagement with said splined shaft for rotating said casing by said shaft in the same direction as the rotational direction of said rotor but at a speed different therefrom.

2. A vane-type pump as claimed in claim 1 wherein said suction and discharge ports are at one of the axial ends of said operating chamber and the other axial end being sealed off from the outside pump.

3. A vane-type pump as claimed in claim 2 wherein said suction and discharge ports are in the end wall of said housing.

4. A vane-type pump as claimed in claim 2 wherein said suction and discharge ports are in said frame.

* * * * *